US009309065B2

(12) United States Patent
Brown et al.

(10) Patent No.: US 9,309,065 B2
(45) Date of Patent: Apr. 12, 2016

(54) PROGRAMMABLE PAPER TRAY AND ELEVATOR SETTINGS

(71) Applicant: XEROX CORPORATION, Norwalk, CT (US)

(72) Inventors: Donald A. Brown, Honeoye Falls, NV (US); Keith L. Willis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/320,679

(22) Filed: Jul. 1, 2014

(65) Prior Publication Data

US 2016/0001993 A1 Jan. 7, 2016

(51) Int. Cl.

| | |
|---|---|
| ***B65H 1/26*** | (2006.01) |
| ***B65H 7/20*** | (2006.01) |
| ***B65H 31/30*** | (2006.01) |

(52) U.S. Cl.

CPC ..... *B65H 1/26* (2013.01); *B65H 1/266* (2013.01); *B65H 7/20* (2013.01); *B65H 31/30* (2013.01); *B65H 2551/21* (2013.01)

(58) Field of Classification Search

CPC ..... B65H 1/26; B65H 1/266; B65H 7/20; B65H 31/30; B65H 2201/01; B65H 2405/32; B65H 2405/324; B65H 2405/35; B65H 2551/10; B65H 2551/20; B65H 2551/21; B65H 2601/321; B65H 2601/322; B65H 2601/325

USPC ..... 271/157, 162, 164, 207, 213

See application file for complete search history.

(56) References Cited

U.S. PATENT DOCUMENTS

| | | | | |
|---|---|---|---|---|
| 4,358,197 | A | 11/1982 | Kukucka et al. | |
| 5,005,817 | A * | 4/1991 | Ruch | B65H 3/44 271/117 |
| 5,044,620 | A * | 9/1991 | Ruch | B65H 1/04 271/162 |
| 5,152,517 | A * | 10/1992 | Ruch | B65H 1/04 271/162 |
| 5,174,223 | A | 12/1992 | Nagy et al. | |
| 5,342,037 | A | 8/1994 | Martin | |
| 5,609,333 | A | 3/1997 | Mandel et al. | |
| 5,870,647 | A | 2/1999 | Nada et al. | |
| 7,551,870 | B2 | 6/2009 | Sato | |
| 7,831,167 | B2 | 11/2010 | Huber et al. | |
| 7,991,307 | B2 | 8/2011 | Kneisel et al. | |
| 2010/0219577 | A1 * | 9/2010 | De Haan | B65H 1/26 271/9.11 |

* cited by examiner

*Primary Examiner* — David H Bollinger

(74) *Attorney, Agent, or Firm* — Gibb & Riley, LLC

(57) ABSTRACT

Devices include a platform having a media side that supports sheets of media. The platform moves in a direction perpendicular to the surface upon which the devices rests between a home position and a plurality of paper supply positions located in an upward direction from the home position. A user interface displays a first reload option that, when selected, lowers the platform to the home position for reloading the sheets of media onto the platform. The user interface also displays an accessibility option for reloading the sheets of media onto the platform that, when selected, lowers the platform to an accessibility position that is in the upward direction relative to the home position.

10 Claims, 11 Drawing Sheets

PROGRAMMABLE PAPER TRAY AND ELEVATOR SETTINGS

BACKGROUND

Systems and methods herein generally relate to devices that feed sheets of media, and more particularly to devices that utilize a reload position for elevator platforms and trays that holds such sheets of media.

Individuals who experience physical challenges, such as those with back injuries, knee injuries, and those individuals in wheelchairs, etc., can often find difficulty when attempting to reload reams of sheets into sheet feeding devices (such as printers, copiers, multifunction devices (MFDs), etc.) For example, some wheelchair customers may be unable to load paper into high capacity feeder trays because the tray elevator lowers down to the bottom of the tray when the tray is opened. Handicap compliance regulations for paper loading (wheelchair customer) sometimes only require that there be a higher located paper tray that the customer can load all paper sizes. However, these higher located paper trays may only hold 500 sheets maximum, and many lower positioned high capacity trays are not designed to provide accessibility for wheelchair customers because, when the high capacity tray is opened, the tray elevator lowers to the bottom of the tray making it difficult for the wheelchair customer to load paper.

SUMMARY

Exemplary devices herein include, among other components, a media path that feeds sheets of media to a processing apparatus, a media supply device positioned to supply the sheets of media to the media path, and a platform within the media supply device. The platform has a media side facing in an upward direction (the upward direction is perpendicular to the planar surface (e.g., floor) upon which the device is positioned) and the media side of the platform supports the sheets of media.

A motor is operatively (meeting directly or indirectly) connected to the platform. The motor moves the platform (in a direction perpendicular to the surface) between the "home" position and a plurality of paper supply positions located in the upward direction from the home position. The "home" position is the position closest to the planar surface upon which the device rests. During normal operations, the platform moves in the upward direction as the media path feeds the sheets of media from the platform.

A controller is also operatively connected to the motor, and a user interface is operatively connected to the controller. The controller causes the user interface to display a normal reload option that, when selected, lowers the platform to the home position for reloading the sheets of media onto the platform. The controller also causes the user interface to display number of menu options, one of which may be an accessibility option for reloading the sheets of media onto the platform. When one or more such accessibility options are selected, the platform lowers to an accessibility position that is in the upward direction relative to the home position, and is more easily accessed by people with disabilities, such as those in wheelchairs. For example, the accessibility position could be set to correspond to a wheelchair armrest height from the surface. The user interface can also display an option to set the accessibility position to a customized accessibility position selected by the user.

Further, a sensor senses the height of the sheets of media on the platform, and selection of the accessibility option causes the motor to lower the platform as the height of the media on the platform increases (as determined by the sensor) during reloading sheets of media onto the platform. Thus, during reloading with an accessibility option selected, the platform lowers as the height of the media on the platform increases (as determined by the sensor) to maintain the top sheet of the sheets of media at the accessibility position to continue to allow easily access for people with disabilities, such as those seated or in wheelchairs.

Other devices herein include a printing apparatus that includes, among other components, a media path feeding sheets of media to a print engine. A media supply device is positioned to supply the sheets of media to the media path, and at least one paper tray is located within the media supply device and maintains the sheets of media. A controller is operatively connected to the paper tray(s), and an actuator is operatively connected to the controller. The actuator opens the paper tray(s) upon instruction from the controller.

A user interface is operatively connected to the controller. The controller causes the user interface to display a normal reload option that, when selected, opens the paper tray when the paper tray is completely empty for reloading the sheets of media into the paper tray. The controller also causes the user interface to display an accessibility option for reloading the sheets of media onto the paper tray that, when selected, opens the paper tray when the paper tray has an accessibility amount of the sheets of media (greater than completely empty) for reloading the sheets of media into the paper tray. The accessibility amount of the sheets maintains a top sheet in the paper tray at an accessibility position that is easily accessed by people with disabilities, such as those seated or in wheelchairs. Thus, a sensor senses the height of the sheets of media in the paper tray. The selection of the accessibility option causes the actuator to open the paper tray when the paper tray has the accessibility amount of the sheets of media. Further, the accessibility option can restrict which paper trays open, so that only a single paper tray of the media supply device opens for reloading the sheets of media when the accessibility option is selected.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, certain users can often find difficulty when attempting to reload reams of sheets into sheet feeding devices (such as printers, copiers, MFDs, etc.). Therefore, the systems and devices herein provide a user interface programmable feature that enables the customer to set the lowering of the paper tray elevator to either lower completely or to lower incrementally (i.e., one sheet or ream at a time), thereby providing a user who may have temporary or permanent physical limitations with the ability to load paper from the same height into a high capacity feeder tray.

Additionally, other systems and devices herein provide a user interface programming feature that enables the wheelchair customer the ability to set an "operational low" paper condition upon which media trays (especially high capacity trays) will open before they are completely empty. This feature is useful for office devices, and also has application in low entry and production environments, such as those with feeder modules that have auto tray switching capability. With these systems and devices, the customer can set the level at which the system would declare an operationally low condition for the tray, causing the trade to automatically open. For example, instead of 4 reams of paper required to fill a tray, the level may be set to declare a low condition a 25% tray capacity (requiring 3 reams of paper to refill the tray). Thus, a wheelchair customer (for example, with the wheelchair seat height of 19" above the floor) may be able to top off the high capacity tray with 3 reams of paper instead of 4 reams.

Figure 1:
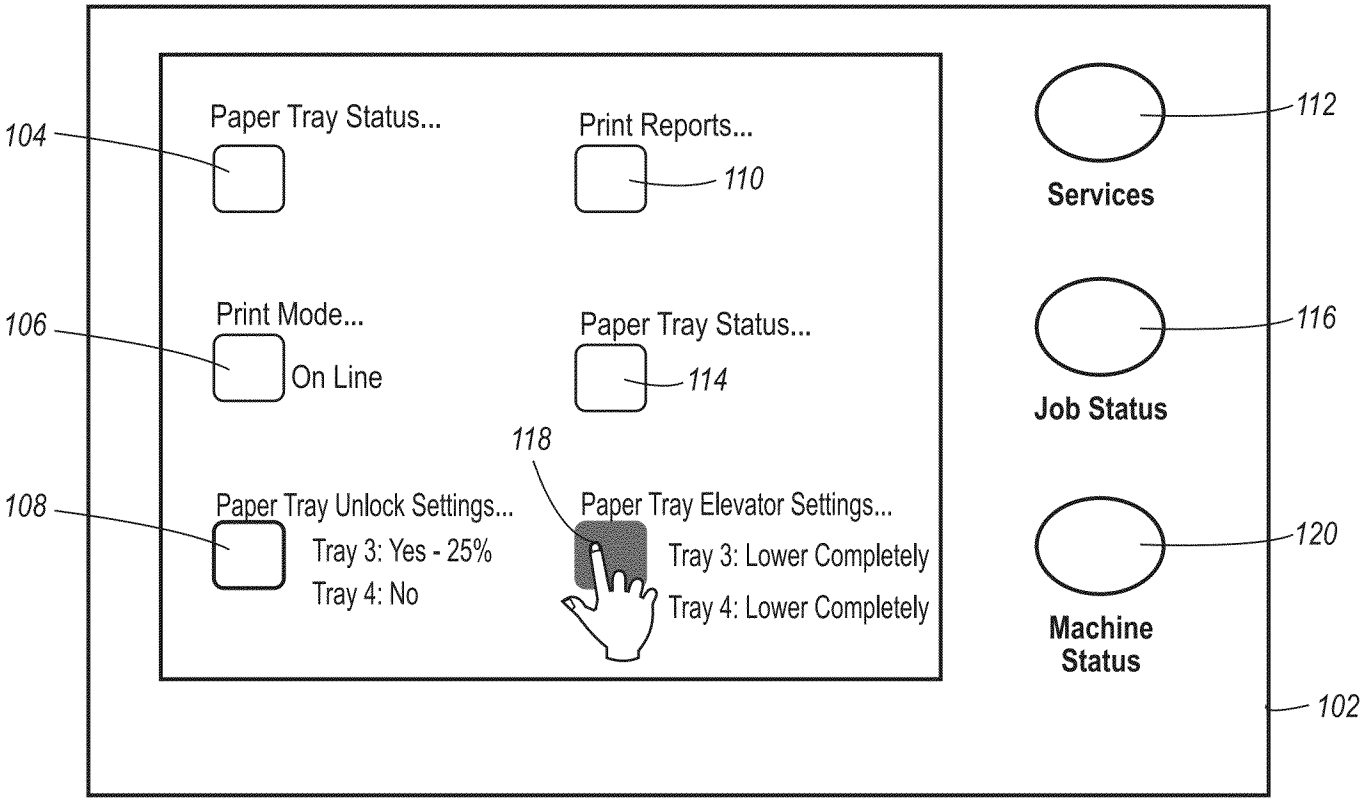
FIG. 1 is a schematic diagram illustrating menu options presented herein.

FIG. 1 illustrates an exemplary graphical user interface screen display (screenshot) 102 that can include various radio-style buttons to select menu options for services 112, job status 116, machine status 120, etc. The graphical user interface 102 can comprise any interface, whether currently known or developed in the future, and items can be selected on the graphical user interface 102 by touching a touch screen, moving and operating buttons on cursor or pointing devices, operating physical buttons surrounding the display screen, etc.

The screenshot shown in FIG. 1 could be presented, for example, if the machine status radio button 120 were selected. As shown in FIG. 1, the additional graphical menu items that are presented include menu items for paper tray status 104, print mode 106, paper tray on lock settings 108, print reports 110, paper tray status 114, paper tray elevator settings 118.

Figure 2:
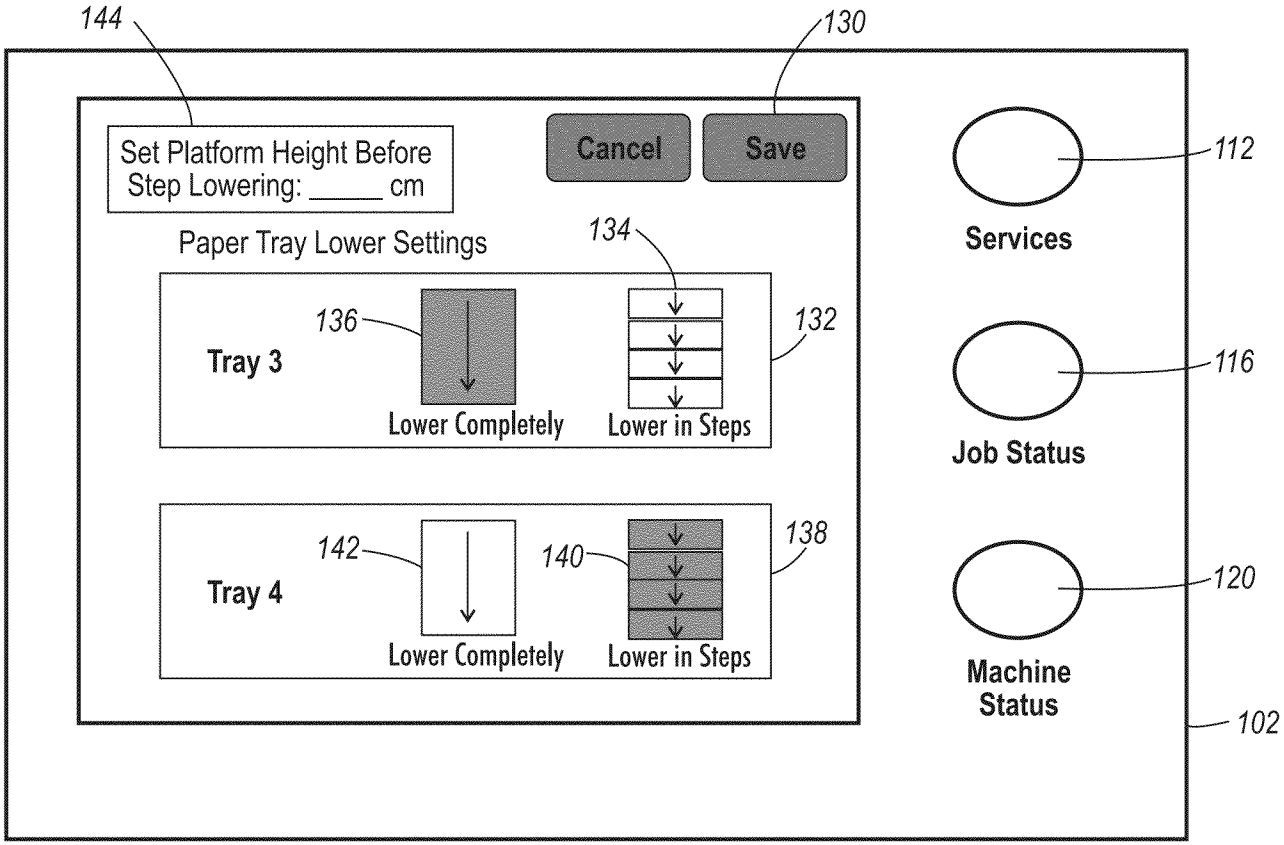
FIG. 2 is a schematic diagram illustrating menu options presented herein.

FIG. 2 illustrates a screenshot 102 that could be displayed upon the selection of the paper tray elevator settings 118 in FIG. 152. More specifically, FIG. 2 illustrates a menu box 132 for tray 3 and a menu box 138 for tray 4, as well as cancel/save buttons 130. The menu box 132 for tray 3 has an option for tray 3 to be lowered completely 136 (which is selected) and an option to lower tray 3 in steps 134 (which is not selected). Similarly, menu box 138 for tray 4 has an option for tray 4 to be lowered completely 142 (which is not selected) and an option to lower tray 3 in steps 134 (which is selected).

When the elevator (which can be within a tray or separate from a tray) lowers in steps (options 134 and 140, shown in FIG. 2), the elevator initially moves to accessibility position that can be factory set, user set, and/or user adjustable. The accessibility position is further from the floor relative to the "lower completely" position (136, 142) and can be, for example, easily reachable from a seated position (such as in a wheelchair). When the user places media on the elevator (such as a ream of paper) a sensor detects how much has been placed upon the elevator. The sensor can be a weight sensor, light sensor, physical gauge sensor, etc. Light sensors or physical gauge sensors can directly determine the height of the media placed upon the elevator, while weight sensors can calculate (or be used to calculate) the height of the media based upon average sheet thickness and weight, etc.

When the sensor detects that sheets of media have been placed upon the elevator, the processor within the media-feeding device causes the elevator to automatically lower a distance equal to the height of the media that has been placed upon the elevator to cause the top sheet on the elevator to remain at the accessibility height. By maintaining the elevator, or the top sheet on the elevator, at the accessibility height during media reload operations, the systems and devices herein allow the user to continually add media (e.g. reams of paper) to the elevator in increments.

The user interface 102 can also display an option to set the accessibility position of the elevator platform to a customized accessibility position selected by the user (144) and this setting can be in specific distances (inches, centimeters, etc.) or can be represented as a percentage of the overall travel height of the elevator platform. The elevator platform moves to the customized accessibility position when the tray is empty before lowering in stages.

Figure 3:
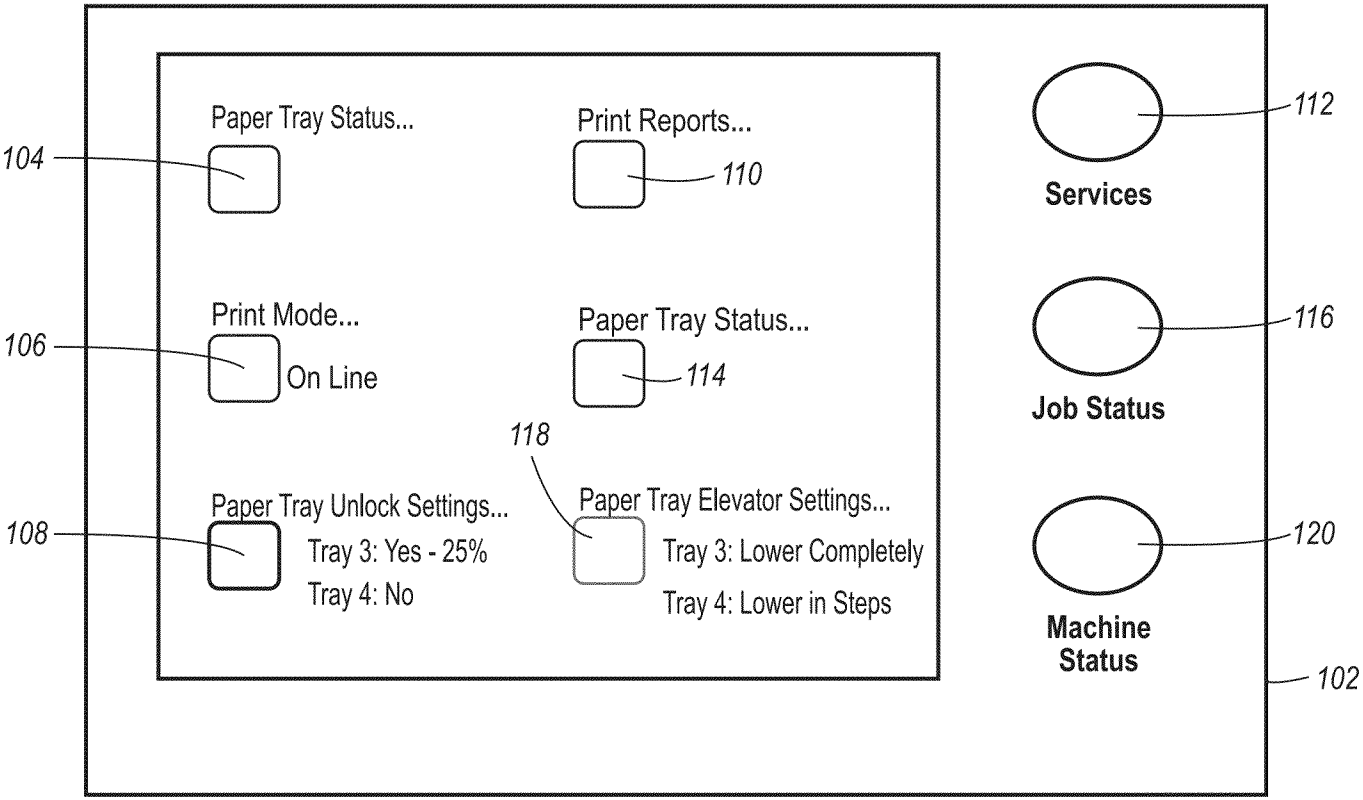
FIG. 3 is a schematic diagram illustrating menu options presented herein.

The settings shown in FIG. 2 can be saved using the save radio button 130, which returns the user interface display 102 to the screenshot shown in FIG. 3. FIG. 3 reflects the changes in the paper tray elevator settings menu selection 118 which now indicates that upon being empty, tray 3 will lower completely, while tray 4 will lower in stages (beginning at the accessibility position). Thus, when tray 4 becomes empty it will initially lower to height that is above the fully lowered height (relative to the floor upon which the device sits) to allow a person with physical challenges to easily load a ream of paper into or onto tray 4.

Figure 4:
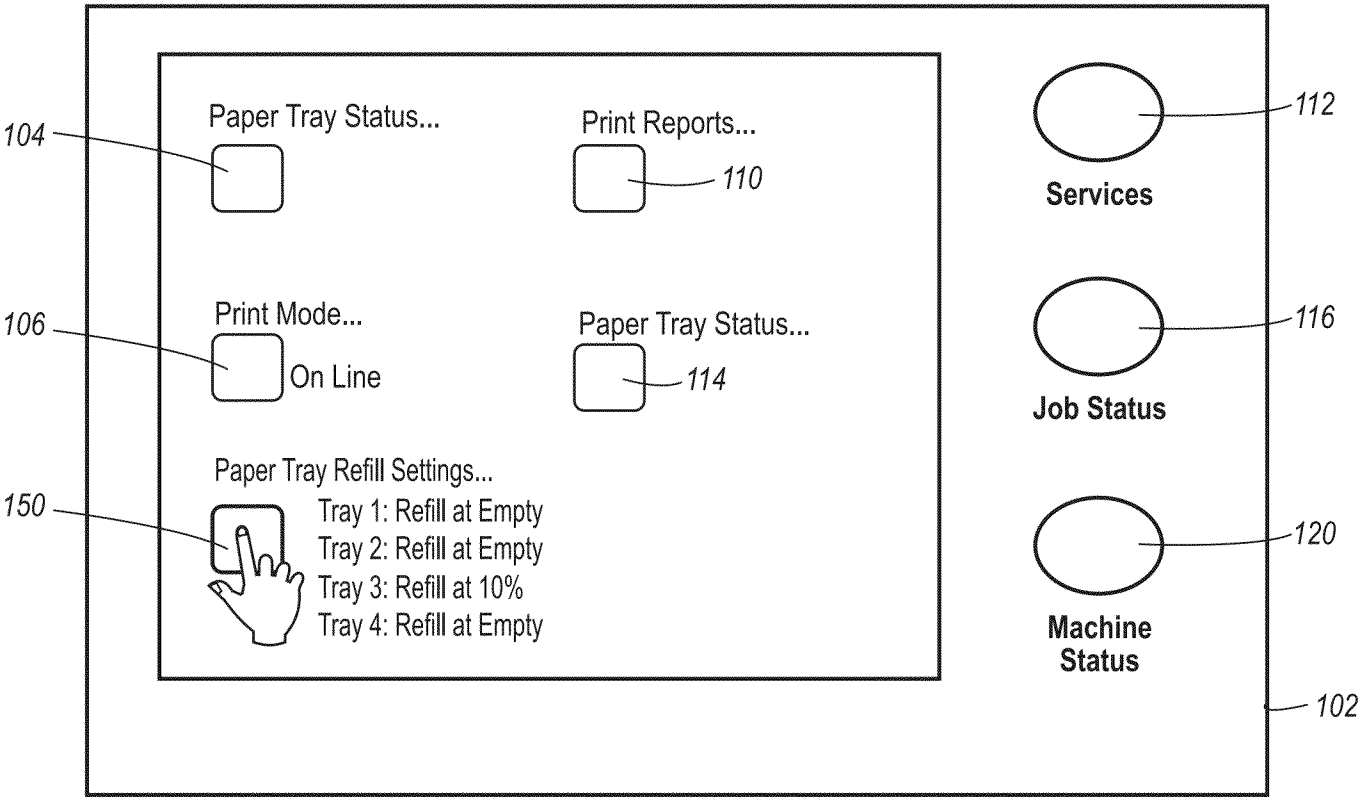
FIG. 4 is a schematic diagram illustrating menu options presented herein.
Figure 5:
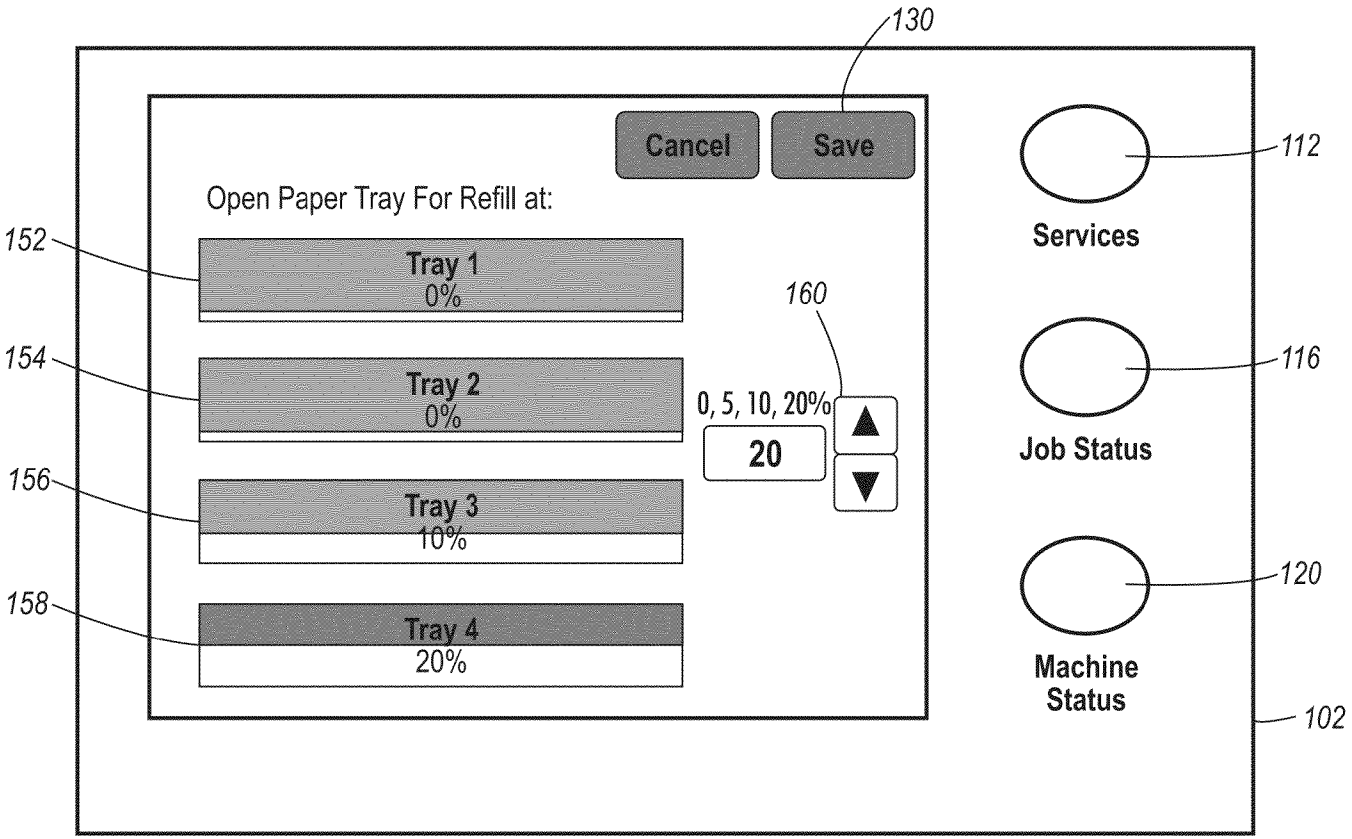
FIG. 5 is a schematic diagram illustrating menu options presented herein.

FIG. 4 is similar to FIGS. 1 and 3; however, in FIG. 4, the paper tray refill settings 150 provide different accessibility options. Upon selection of item 150 in FIG. 4, the screenshot shown in the graphical user interface 102 in FIG. 5 is displayed to the user. As shown in FIG. 5, different paper trays can be selected by selecting tray 1 (152), tray 2 (154), tray 3 (156), tray 4 (158), etc. In the example shown in FIG. 5, tray 4 (158) has been selected and the percentage selector 160 has been changed to 20% (causing tray 4 to open when 20% of the media remains within tray 4). Previously, tray 3 has been set to open when 10% of the media remains within tray 3. Upon execution of the save button 130, the screenshot 102 shown in FIG. 6 appears, showing the changes made in FIG. 5 in item 150.

While FIG. 5 illustrates the operation of the accessibility option using percentages of the capacity of different paper trays, the numbers in FIG. 5 also illustrate heights (in inches, centimeters, etc.) from the bottom of the paper tray or from the floor upon which the device rests as an alternative to percentages. Therefore, the numbers and shading in menu items 156 and 158 in FIG. 5 are also intended to alternatively represent a specific distance (the standardized or customized accessibility position) relative to the bottom of the tray or the floor upon which the machine rests.

Figure 6:
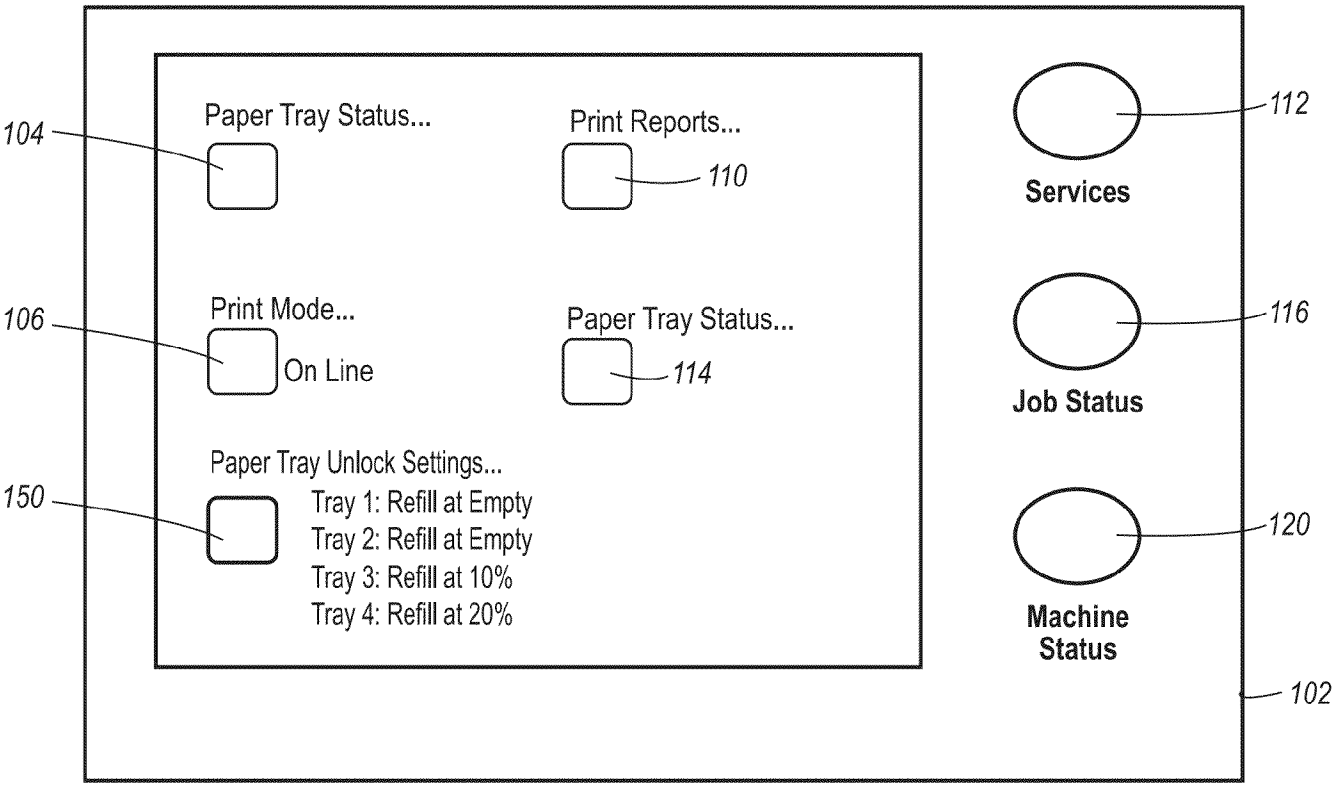
FIG. 6 is a schematic diagram illustrating menu options presented herein.
Figure 7:
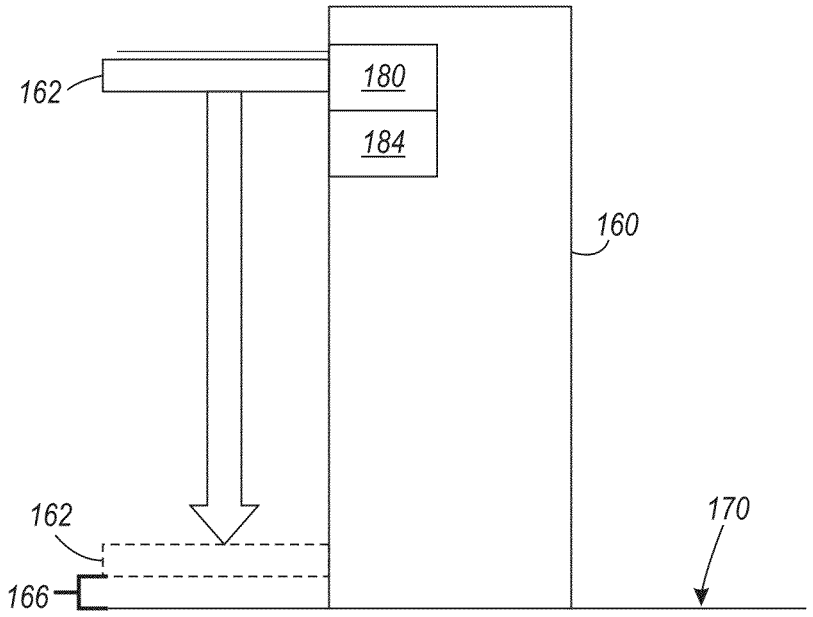
FIG. 7 is a schematic diagram illustrating devices herein.

The user-adjustable (or automatically preconfigured) options shown in FIGS. 4-6 cause one or more of the paper trays to open before the paper tray is completely empty. In this situation, the top sheet of media within the paper tray is at a more accessible height for those with physical limitations (relative to the very bottom of the paper tray, which would be exposed if the paper tray waited until being empty to open). In some situations, the paper tray could be set to open so that the top sheet of media within the paper tray is at the accessibility height discussed above (a height that is easily accessible by one in a seated position (such as a user in a wheelchair)). While this option may result in the paper tray being refilled more often, it can make additional paper trays available that were not previously accessible to physically challenged users.

Figure 10:
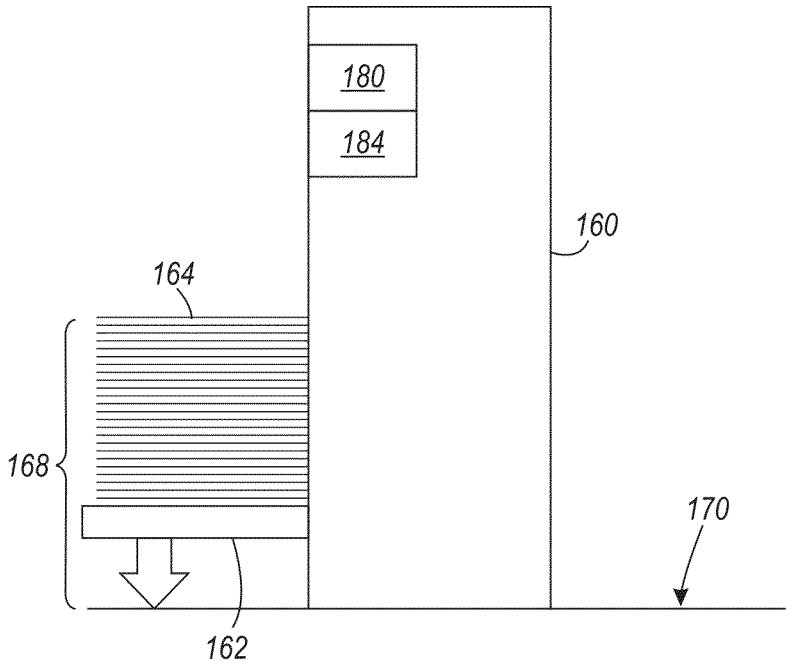
FIG. 10 is a schematic diagram illustrating devices herein.
Figure 11:
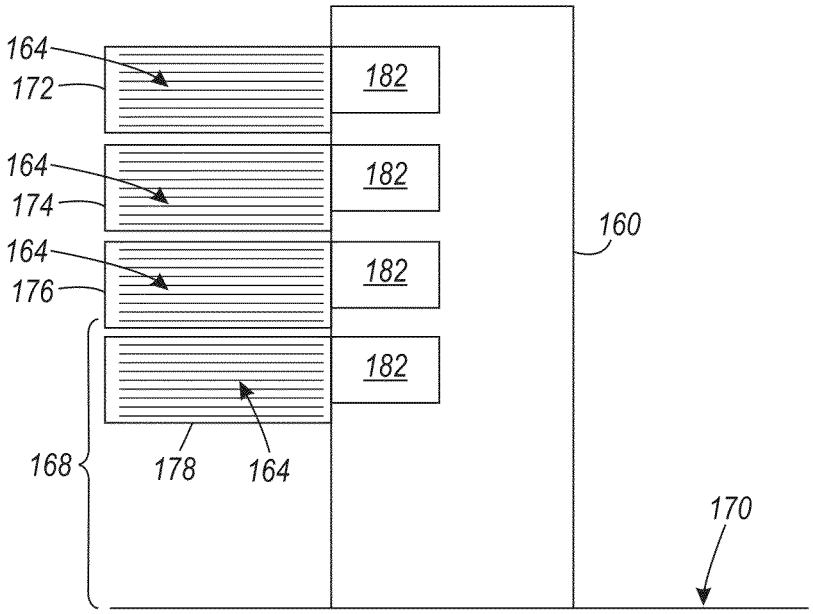
FIG. 11 is a schematic diagram illustrating devices herein.
Figure 12:
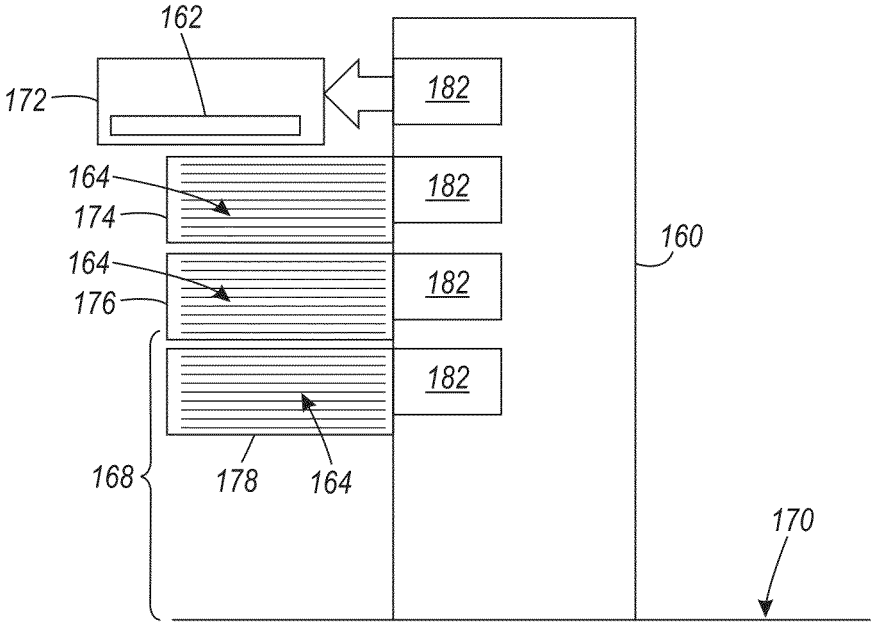
FIG. 12 is a schematic diagram illustrating devices herein.

FIGS. 7-14 illustrate various exemplary devices herein that can include, among other components, a media path 236 that feeds sheets of media 164 to a processing apparatus 240 (see FIG. 14, discussed in detail below, regarding details of the complete media processing device), a media supply device 160 positioned to supply the sheets of media 164 to the media path, and an elevator platform 162 within the media supply device 160. The elevator platform 162 can be contained within a paper tray (172, as shown in FIG. 12) or can be a stand-alone device and is illustrated in FIGS. 7-10 as a stand alone device for simplicity of illustration, but those ordinarily skilled in the art would understand that the same could be positioned within any of the other paper trays (e.g., 172, 174, 176, 178) that are illustrated in other drawings herein. The elevator platform 162 has a media side facing in an upward direction (the upward direction is perpendicular to the planar surface 170 upon which the device is positioned), and the media side of the elevator platform 162 supports the sheets of media 164.

A motor 180 is operatively (meeting directly or indirectly) connected to the elevator platform 162. The motor 180 moves the elevator platform 162 (in a direction perpendicular to the surface) between the "home" position and a plurality of paper supply positions located in the upward direction from the home position. The "home" position is the position 166 closest to the planar surface 170 upon which the device rests, as shown by the dashed box 162 in FIG. 1. During normal operations, the elevator platform 162 moves in the upward direction as the media path feeds the sheets of media 164 from the elevator platform 162. As shown by the arrow in FIG. 1, when reloading is necessary because the elevator platform 162 is empty (does not contain any sheets of media 164) as determined by the sensor 184, the elevator platform 162 returns to the home position, which is the standard reload distance 166 from the planar surface 170.

A controller 216 (FIG. 14) is also operatively connected to the motor 180, and a user interface 212 (FIG. 14) is operatively connected to the controller 216. The controller 216 causes the user interface 212 to display a normal reload option 136 that, when selected, lowers the elevator platform 162 to the home position 166 for reloading the sheets of media 164 onto the elevator platform 162. The controller 216 also causes the user interface 212 to display a number of menu options (FIGS. 1-3), one of which may be an accessibility option 140 for reloading the sheets of media 164 onto the elevator platform 162.

Figure 8:
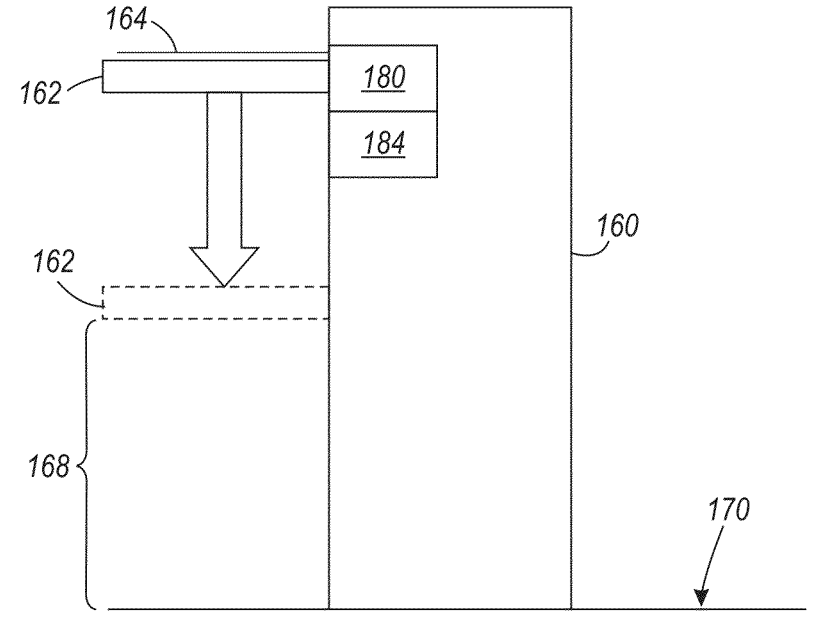
FIG. 8 is a schematic diagram illustrating devices herein.

As shown in FIG. 8, when one or more such accessibility options 140 are selected, the elevator platform 162 lowers to an accessibility position 168 that is in the upward direction relative to the home position 166, and is more easily accessed by people with disabilities, such as those with knee injuries, back injuries, in wheelchairs, etc. Thus, the accessibility position 168 is further from the surface 170 relative to the home position 166. Stated differently, the height from the surface 170 of the accessibility position 168 can be a multiple (e.g., 5 times, 10 times, 20 times, etc.) of the height from the surface 170 of the home position 166. For example, the accessibility position 168 could be set to correspond to a wheelchair armrest height from the surface 170.

The user interface 212 can also display an option to set the accessibility position 168 of the elevator platform to a customized accessibility position selected by the user (144, FIG. 2) and this setting can be in specific distances (inches, centimeters, etc.) or can be represented as a percentage of the overall travel height of the elevator platform. The elevator platform moves to the customized accessibility position when the tray is empty, and before automatically lowering (potentially in increments) as additional sheets of media 164 are added to the elevator platform 162 by the user during the reloading process.

Further, the sensor 184 senses the height of the sheets of media 164 on the elevator platform 162, and selection of the accessibility option causes the motor 180 to lower the elevator platform 162 as the height of the media on the elevator platform 162 increases (as determined by the sensor 184) during reloading sheets of media 164 onto the elevator platform 162. As noted above, the sensor 184 can be a weight sensor, light sensor, physical gauge sensor, etc. Light sensors or physical gauge sensors can directly determine the height of the media placed upon the elevator, while weight sensors can calculate (or be used to calculate) the height of the media based upon average sheet thickness and weight, etc.

Figure 9:
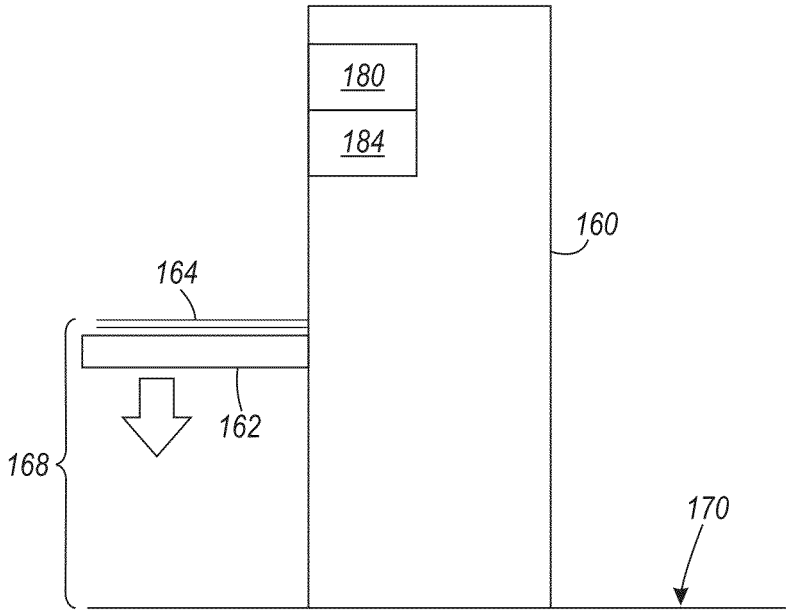
FIG. 9 is a schematic diagram illustrating devices herein.

Therefore, as shown in FIGS. 9 and 10, when the sensor 184 detects that sheets of media 164 have been placed upon the elevator 162, the processor within the media-feeding device causes the elevator 162 to automatically lower a distance equal to the height of the media that has been placed upon the elevator to cause the top sheet on the elevator to remain at the accessibility height 168. Therefore, both FIGS. 9 and 10 illustrate that the top sheet within the stack of sheets 164 is positioned at the accessibility position 168 and the block arrows in FIGS. 9 and 10 show that the elevator platform 162 moves toward the surface 170 as additional sheets are added to the stack 164. By maintaining the elevator 162, or the top sheet 164 on the elevator 162, at the accessibility height 168 during media reload operations, the systems and devices herein allow the user to continually add media (e.g., sheets or reams of paper) to the elevator platform 164 using the convenient accessibility position 168. Further, if the accessibility position 168 has been customized using item 144 shown in FIG. 2, the top sheet 162 on the elevator 164 is maintained at the customized accessibility position (also represented by item 168 in the drawings).

Thus, during reloading with an accessibility option selected, the elevator platform 162 lowers as the height of the media 164 on the elevator platform 162 increases (as determined by the sensor 184) to maintain the top sheet of the sheets of media 164 at the accessibility position (or the customized accessibility position) 168 to continue to allow easily access for people with disabilities, such as those in wheelchairs.

Figure 13:
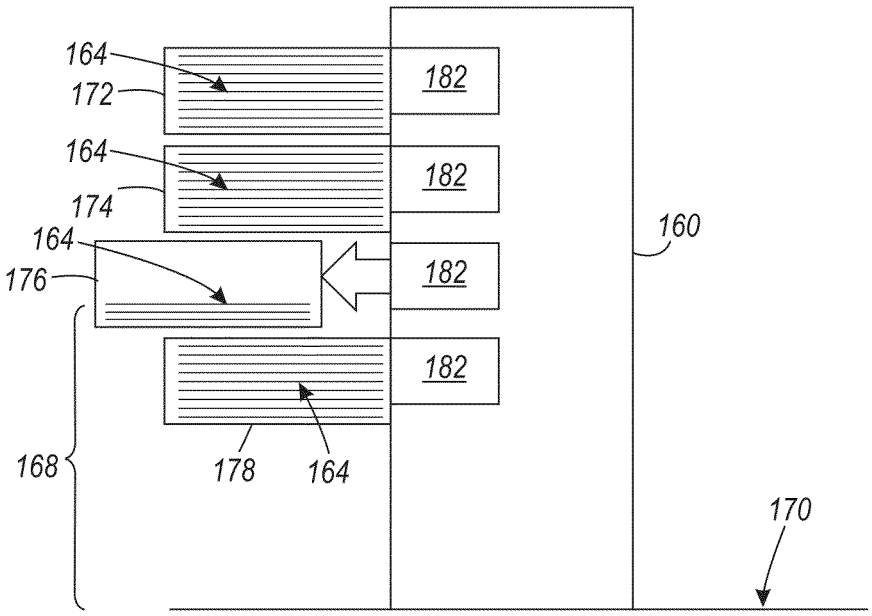
FIG. 13 is a schematic diagram illustrating devices herein.

Other devices herein shown in FIGS. 11-13 similarly include a media supply device 160 that is positioned to supply the sheets of media 164 to the media path. At least one paper tray 172, 174, 176, 178 is located within the media supply device 160 and maintains the sheets of media 164. A controller 216 is operatively connected to the paper tray(s), and an actuator 182 is operatively connected to the controller 216. The actuator 182 opens the paper tray(s) 172, 174, 176, 178 upon instruction from the controller 216.

The controller 216 causes the user interface 212 to display a normal reload option (items 150 and 154 in FIG. 5) that, when selected, opens the paper tray when the paper tray is completely empty (has no remaining sheets of media therein) for reloading the sheets of media 164 into the paper tray. The controller 216 also causes the user interface 212 to display an accessibility option (items 156 and 158 in FIG. 5) for reloading the sheets of media 164 onto the paper tray that, when selected, opens the paper tray when the paper tray has an accessibility amount of the sheets of media 164 (greater than completely empty, e.g., at least one sheet of media) for reloading the sheets of media 164 into the paper tray.

Therefore, as shown in FIG. 11, all paper trays 172, 174, 176, 178 can be fully loaded with sheets of media 164. In FIG. 12, tray 1 (172) is automatically opened by the actuator 182 only when it is completely empty (and this is consistent with option item 152 in FIG. 5). However, because tray 3 has been set in item 156 in FIG. 5 to open when 10 units (e.g., percent, inches, centimeters, pages, etc.) of the tray media sheet capacity is reached, as shown in FIG. 13, tray 3 (176) is automatically opened by the actuator 182 even when there are still sheets of media 164 remaining in tray 176 (and here the remaining amount is 10 units of tray 3's sheet capacity). Further, 10 units of tray 3's sheet capacity positions the top sheet of media 164 within tray 3 (176) at the accessibility position 168.

As noted above, while FIG. 5 illustrates the operation of the accessibility option using percentages of the capacity different paper trays, the numbers in FIG. 5 also illustrate heights (in inches, centimeters, etc.) from the bottom of the paper tray or from the floor upon which the device rests. Therefore, the numbers and shading in menu items 156, and 158 in FIG. 5 also represent a specific distance (the standardized or customized accessibility position 168) relative to the bottom of a tray or the floor 170 upon which the machine 160 rests. Thus, the accessibility amount maintains the top sheet 164 in the paper tray 176 at a predetermined height during reload, which can be set by the user (or can be previously established during machine set up) and this maintains the top sheet 164 in the paper tray 176 at the accessibility position 168 that is easily accessed by people with physical limitations, such as those in wheelchairs, during reloading of media.

Thus, sensors in the trays 172, 174, 176, 178, sense the height of the sheets of media 164 in the paper tray. The selection of the accessibility option causes the actuator 182 to open the paper tray when the paper tray has the accessibility amount of sheets of media 164. Further, the accessibility option can restrict which paper trays open, so that only a single paper tray (e.g., only tray 176) of the media supply device 160 opens for reloading the sheets of media 164 when the accessibility option is selected (to prevent trays that are too low or too high from being utilized with the accessibility option).

Figure 14:
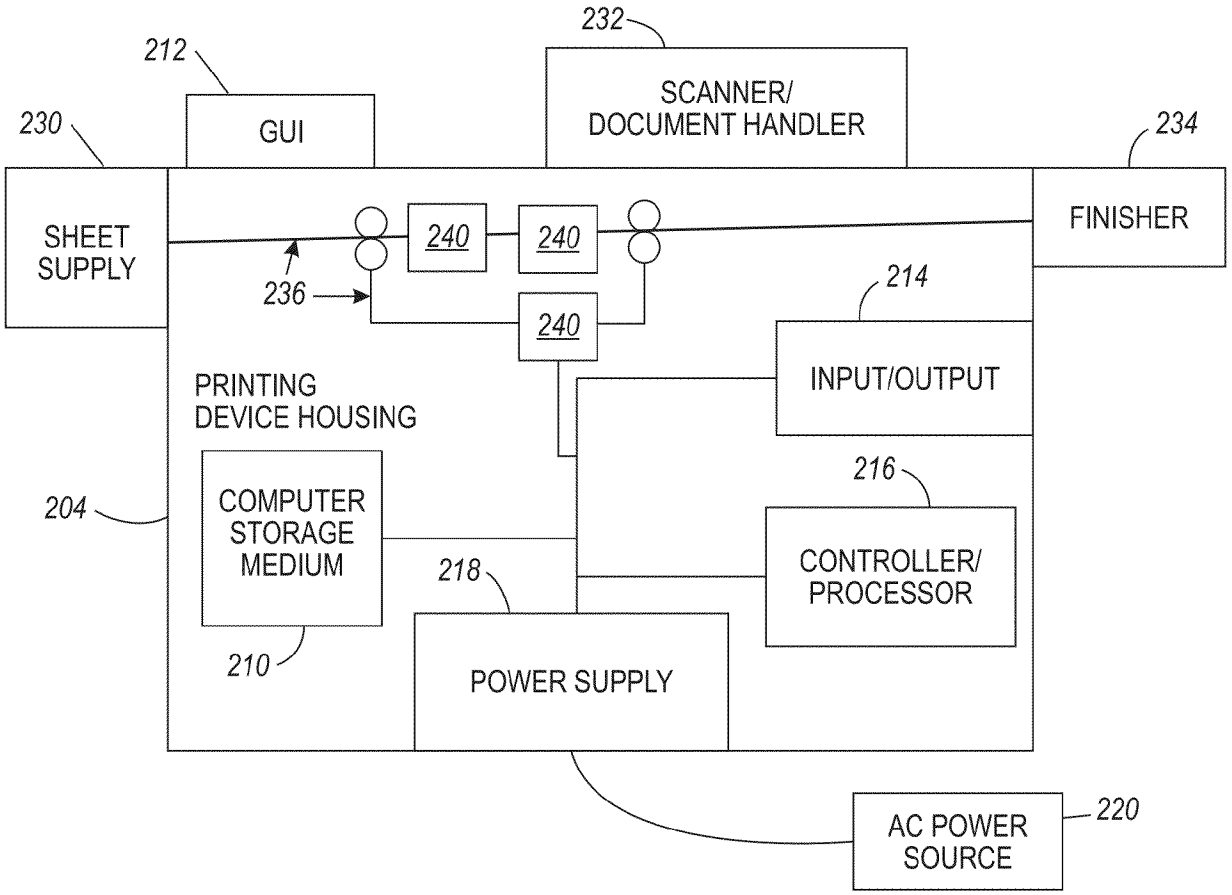
FIG. 14 is a schematic diagram illustrating devices herein.

FIG. 14 illustrates a computerized device that is a printing device 204, which can be used with systems and methods herein and can comprise, for example, a printer, copier, multi-function machine, multi-function device (MFD), etc. The printing device 204 includes a controller/tangible processor 216 and a communications port (input/output) 214 operatively connected to the tangible processor 216 and to a computerized network external to the printing device 204. Also, the printing device 204 can include at least one accessory functional component, such as a graphical user interface (GUI) assembly 212 that also operate on the power supplied from the external power source 220 (through the power supply 218). The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 216 controls the various actions of the computerized device. A non-transitory, tangible, computer storage medium device 210 (which can be optical, magnetic, capacitor based, etc., and is different from a transitory signal) is readable by the tangible processor 216 and stores instructions that the tangible processor 216 executes to allow the computerized device to perform its various functions, such as those described herein. Thus, as shown in FIG. 14, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to the tangible processor 216, a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, etc.) to continuous media or sheets of media, whether currently known or developed in the future and can include, for example, devices that use a photoreceptor belt or an intermediate transfer belt, or devices that print directly to print media (e.g., inkjet printers, ribbon-based contact printers, etc.).

As would be understood by those ordinarily skilled in the art, the printing device 204 shown in FIG. 14 is only one example and the systems and methods herein are equally applicable to other types of printing devices that may include fewer components or more components. For example, while a limited number of printing engines and paper paths are illustrated in FIG. 14, those ordinarily skilled in the art would understand that many more paper paths and additional printing engines could be included within any printing device used with systems and methods herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus:

a paper tray maintaining sheets of media, said paper tray being openable and closable;

a sensor operatively connected to said paper tray, said sensor sensing a height of said sheets of media in said paper tray to determine is said paper tray is completely empty of said sheets of media, and to determine if said paper tray has an accessibility amount of said sheets of media;

a controller operatively connected to said paper tray;

an actuator operatively connected to said controller and said paper tray, said actuator opening said paper tray upon instruction from said controller; and a user interface operatively connected to said controller, said controller causing said user interface to display a reload option that, when selected, opens said paper tray when said paper tray is said completely empty for reloading said sheets of media into said paper tray, said controller causing said user interface to display an accessibility option for reloading said sheets of media onto said paper tray that, when selected, opens said paper tray when said paper tray has said accessibility amount of said sheets of media for reloading said sheets of media into said paper tray, said accessibility amount of said sheets being greater than said completely empty, and a top sheet in said paper tray being at an accessibility position when said accessibility amount of said sheets is within said paper tray.

2. The apparatus according to claim 1, said selection of said accessibility option causing said actuator to open said paper tray when said paper tray has said accessibility amount of said sheets of media.

3. The apparatus according to claim 2, said accessibility position corresponding to a wheelchair armrest height from a surface upon which said apparatus is positioned.

4. The apparatus according to claim 1, said user interface displaying an option to set said accessibility position to a customized accessibility position.

5. The apparatus according to claim 1, said accessibility option restricting a single paper tray of said apparatus to open for reloading said sheets of media.

6. A printing apparatus:

a media path feeding sheets of media to a print engine;

a media supply device positioned to supply said sheets of media to said media path;

a paper tray within said media supply device maintaining said sheets of media said paper tray being openable and closable;

a sensor operatively connected to said paper tray, said sensor sensing a height of said sheets of media in said paper tray to determine is said paper tray is completely empty of said sheets of media, and to determine if said paper tray has an accessibility amount of said sheets of media;

a controller operatively connected to said paper tray;

an actuator operatively connected to said controller and said paper tray, said actuator opening said paper tray upon instruction from said controller; and a user interface operatively connected to said controller, said controller causing said user interface to display a reload option that, when selected, opens said paper tray when said paper tray is said completely empty for reloading said sheets of media into said paper tray, said controller causing said user interface to display an accessibility option for reloading said sheets of media onto said paper tray that, when selected, opens said paper tray when said paper tray has said accessibility amount of said sheets of media for reloading said sheets of media into said paper tray, said accessibility amount of said sheets being greater than said completely empty, and a top sheet in said paper tray being at an accessibility position when said accessibility amount of said sheets is within said paper tray.

7. The printing apparatus according to claim 6, said selection of said accessibility option causing said actuator to open said paper tray when said paper tray has said accessibility amount of said sheets of media.

8. The printing apparatus according to claim 7, said accessibility position corresponding to a wheelchair armrest height from a surface upon which said printing apparatus is positioned.

9. The printing apparatus according to claim 6, said user interface displaying an option to set said accessibility position to a customized accessibility position.

10. The printing apparatus according to claim 6, said accessibility option restricting a single paper tray of said media supply device to open for reloading said sheets of media.

* * * * *